US009918528B2

(12) United States Patent
Taylor

(10) Patent No.: US 9,918,528 B2
(45) Date of Patent: Mar. 20, 2018

(54) BEADED DECORATIVE ACCESSORIES AND METHODS OF MAKING BEADED DECORATIVE ACCESSORIES

(71) Applicant: Dee Taylor, Fairview, NJ (US)

(72) Inventor: Dee Taylor, Fairview, NJ (US)

( * ) Notice: Subject to any disclaimer, the term of this patent is extended or adjusted under 35 U.S.C. 154(b) by 740 days.

(21) Appl. No.: 14/090,711

(22) Filed: Nov. 26, 2013

(65) Prior Publication Data

US 2014/0147614 A1 May 29, 2014

Related U.S. Application Data

(60) Provisional application No. 61/796,968, filed on Nov. 26, 2012.

(51) Int. Cl.

| | |
|---|---|
| ***A44C 9/00*** | (2006.01) |
| ***A44C 17/02*** | (2006.01) |
| ***A44C 15/00*** | (2006.01) |

(52) U.S. Cl.

CPC ..... *A44C 9/00* (2013.01); *A44C 9/0061* (2013.01); *A44C 15/005* (2013.01); *A44C 17/02* (2013.01); *A44C 17/0266* (2013.01); *Y10T 428/22* (2015.01)

(58) Field of Classification Search

CPC ..... A44C 9/00; A44C 15/005; A44C 17/02; A44C 17/0266; A44C 9/0061; B44F 5/00; Y10T 428/22

USPC ..... 428/67

See application file for complete search history.

(56) References Cited

U.S. PATENT DOCUMENTS

| | | | | |
|---|---|---|---|---|
| 5,494,734 A * | 2/1996 | Widders | D04D 7/02 428/11 |
| 6,006,547 A * | 12/1999 | Bergagnini | A44C 3/008 63/23 |
| 6,378,334 B1 * | 4/2002 | Hector | A44C 11/002 63/26 |
| 2007/0044512 A1 * | 3/2007 | Smith | A44C 17/0216 63/40 |
| 2009/0199593 A1 * | 8/2009 | Corvino | A44C 9/00 63/26 |

* cited by examiner

*Primary Examiner* — Brian Handville

(74) *Attorney, Agent, or Firm* — Doherty IP Law Group LLC

(57) ABSTRACT

A decorative accessory includes a plate having a top surface, a bottom surface, and a plurality of openings extending through said plate, and a frame connected with and extending around an outer perimeter of the plate, whereby the frame projects from the bottom surface of the plate to define a partially enclosed area located beneath the bottom surface of the plate. The accessory includes at least one bead overlying the top surface of the plate, and at least one flexible securing element passing through the at least one bead, the at least one flexible securing element having first and second free ends that pass through different openings in the plate. The first and second free ends of the at least one flexible securing element are joined together beneath the bottom surface of the plate for securing the at least one bead to the plate.

24 Claims, 18 Drawing Sheets

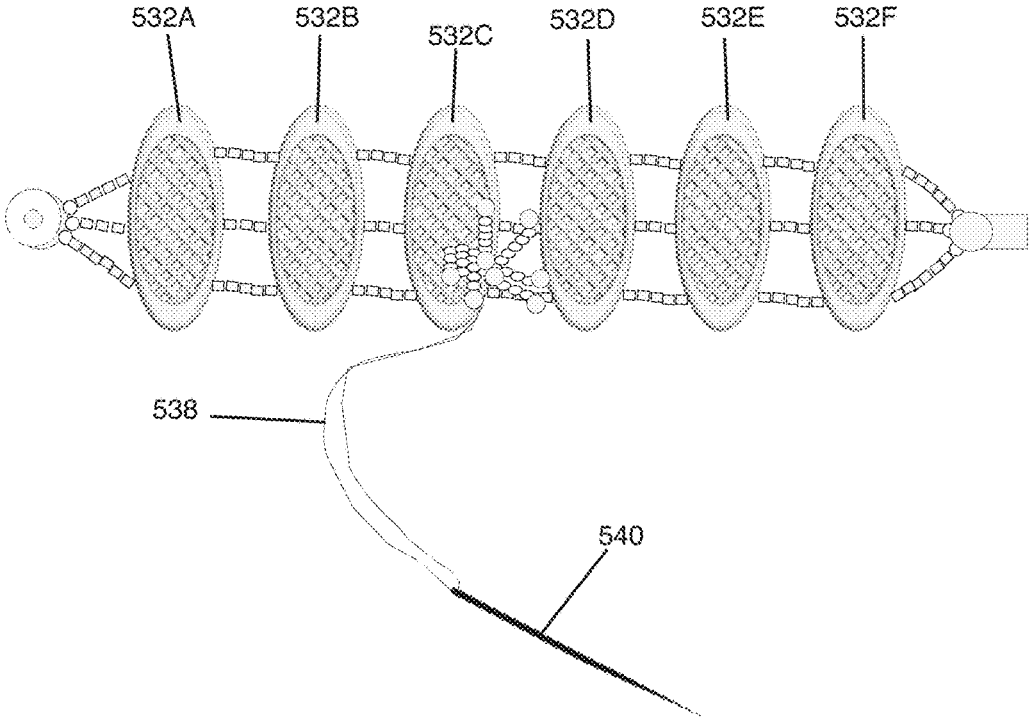
FIG. 12A
FIG. 12B
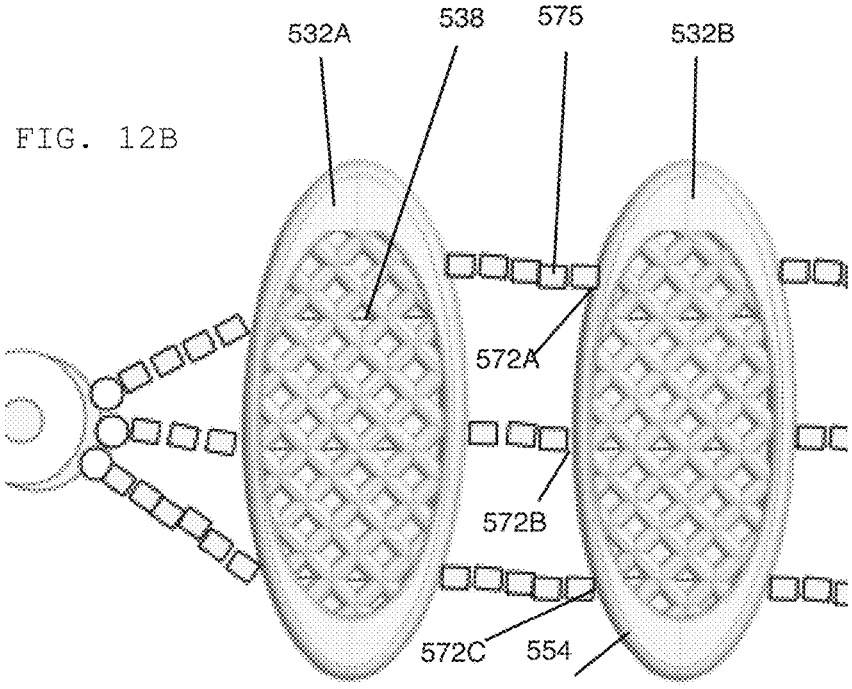

BEADED DECORATIVE ACCESSORIES AND METHODS OF MAKING BEADED DECORATIVE ACCESSORIES

CROSS REFERENCE TO RELATED APPLICATIONS

The present application claims benefit of PCT/IB2013/050874, filed Feb. 1, 2013, and U.S. Provisional Application No. 61/796,968, filed Nov. 26, 2012, the disclosures of which are hereby incorporated by reference herein.

BACKGROUND OF THE INVENTION

Field of the Invention

The present application is generally related to decorative accessories and is more specifically related to decorative accessories having beads secured thereto and methods of making beaded decorative accessories.

Description of the Related Art

Currently, there are several techniques used in needlepoint, jewelry making, and art work for attaching or making a decorative beaded article whereby beads are woven or attached to a substrate such as a canvas or fabric sheet. In these conventional techniques, the work is created by attaching, weaving or stringing beads onto the substrate or fabric sheet by hand, loom or similar mechanism.

Kits are popular with artists and crafters whereby a pattern is pre-formed on a substrate, and the pattern is used to stitch a variety of designs onto the substrate to create an artwork. In some kits, the beads are stitched individually onto a substrate, usually in a horizontal, diagonal or other pattern to hold the beads to the substrate, thereby converting the beads into a beaded art form having a desired pattern.

There have been numerous advances related to stitching beads onto a flexible substrate or mesh such as U.S. Pat. No. 5,494,734 Wilders, U.S. Pat. No. 6,686,021 to Case, U.S. Pat. No. 6,378,334 to Hector, U.S. Pat. No. 6,318,122 to Burgard, U.S. Pat. No. 2,102,746 Reilly, U.S. Pat. No. 4,530,665 to Colonel, and U.S. Pat. No. 4,016,183 to Wallach. The above disclosures teach methods and systems of beading, however, they are not suitable for making beaded decorative accessories that may be worn as jewelry or attached to clothing, home and/or office goods.

Thus, there remains a need for improved systems, kits and methods of making beaded decorative accessories.

SUMMARY OF THE INVENTION

In one embodiment, a decorative accessory preferably includes a plate having a top surface, a bottom surface, and a plurality of openings extending through the plate, and a frame connected with and extending around an outer perimeter of the plate, whereby the frame projects from the bottom surface of the plate to define a partially enclosed area located beneath the bottom surface of the plate. In one embodiment, the plate and the frame are formed as one solid piece. In one embodiment, the plate and frame are two separate pieces that are connected together. The decorative accessory desirably includes at least one bead overlying the top surface of the plate, and at least one flexible securing element passing through the at least one bead, the at least one flexible securing element having first and second free ends that pass through different openings in the plate, whereby the first and second free ends of the at least one flexible securing element are joined together beneath the bottom surface of the plate for securing the at least one bead to the plate.

In one embodiment, a bead may be any object having a hole, whereby a flexible securing element may be passed through the hole of the bead for stringing the bead onto the flexible securing element. The present invention contemplates that the beads may have any size, shape and/or configuration, and may be made of any material and still fall within the scope of the present invention.

In one embodiment, the openings in the plate are spaced from one another. In one embodiment, the openings may be evenly spaced from one another. In one embodiment, the plate preferably includes a lattice structure having crossed strips that define the spaced openings.

In one embodiment, the frame has one or more lateral openings extending therethrough for interconnecting a plurality of decorative accessories together.

In one embodiment, the first and second free ends of the at least one flexible securing element may be joined together by knotting, tying or twisting the flexible securing elements together within the partially enclosed area located beneath the bottom surface of the plate. In one embodiment, the joined first and second free ends of the at least one flexible securing element abut against at least one of the crossed strips of the lattice structure.

In one embodiment, the decorative accessory desirably includes a plurality of beads overlying the top surface of the plate, and a plurality of flexible securing elements for securing the beads to the plate, whereby free ends of the flexible securing elements are joined together beneath the bottom surface of the plate. In one embodiment, each of the flexible securing elements secures one or more of the beads to the plate.

In one embodiment, the free ends of the flexible securing elements are joined together. In one embodiment, the frame has a lower end that extends down from the bottom surface of the plate for defining the partially enclosed area, and the joined together flexible securing elements are surrounded by the frame and located within the partially enclosed area located beneath the bottom surface of the plate. In one embodiment, at least some of the joined together flexible securing elements are knotted, tied onto and/or twisted about at least some of the crossed strips of the lattice structure of the plate. In one embodiment, a flexible securing element may be passed through an opening and advanced below the plate without being knotted, tied and/or twisted below the plate, and then may be passed through another opening and pulled above the plate for being strung through beads located above the top surface of the plate.

In one embodiment, the plate and the frame may be made of metal such as pewter, silver, and gold, or polymers and plastics such as Lucite. In one embodiment, the flexible securing element may be made of flexible, durable materials such as nylon thread, flexible thread, polymer thread, wire, leather, ribbon, fabric, rope, string, yarn, hemp and/or pipe cleaners.

In one embodiment, the decorative accessory may be jewelry, a ring, a hairpiece, a clothing accessory, a button, a head band, a novelty box, a storage box, a storage container, a paper weight, a bracelet, a necklace, a neck piece, earrings, ear cuffs, a belt buckle, clasps, links, armlets, bangles, chains, brooches, anklets, lockets, pearls, connectors, charms, pendants, cuff links, tie pins, breastplates, nose rings, and/or nose studs. The decorative accessories disclosed herein may also be used for key chains, door knob décor, scarf connectors, flower ties, gift ties, ribbon bow ties, novelty shapes, and/or novelty boxes.

The decorative accessories disclosed herein may also be used as hair accessories such as hair pins, hair sticks, barrettes, head bands, decorative scrunchies, head wraps, hair clips, ponytailers, hair claws, decorative combs, bun-holders, and/or tiaras.

In one embodiment, the decorative accessories may include home goods such as napkin holders, place mats, vases, wine labels, glass labels such as charms, stirrers, markers (e.g., for parties so glasses do not get mixed up), lamps, lampshades, light fixtures, decorative plates and bowls, planting pots, curtains, curtain pull/cords, decorative light pulls, decorative light switches, kitchen storage containers, bookends, table cloths, furniture accessories such as decorative studs or decorative foot stools, decorative table parts, a lampshade, a napkin ring and/or a paper weight.

In one embodiment, the decorative accessories may include office goods such as desk accessories, organizers, paper weights, storage boxes, decorative plated for a desk, drawer knobs, and/or door knobs.

In one embodiment, a backing material, such as a metal backing, a fabric backing, or a foam backing, may be inserted into the partially enclosed area beneath the bottom surface of the plate for covering the joined, tied, knotted and/or twisted flexible securing elements located beneath the bottom surface of the plate. The frame may surround the backing material and may hold the backing material in place beneath the bottom surface of the plate In one embodiment, the decorative accessory and/or plate may have a spherical, round or globe shape.

In one embodiment, the present invention may be used for making murals.

In one embodiment, a decorative accessory desirably includes a plate having a top surface, a bottom surface, and a plurality of openings extending through the plate, and a frame connected with and extending around an outer perimeter of the plate, whereby the frame projects from the bottom surface of the plate to define a partially enclosed area located beneath the bottom surface of the plate. In one embodiment, a plurality of beads overlying the top surface of the plate, and a plurality of securing elements secure the beads to the plate. In one embodiment, each flexible securing element preferably passes through at least one of the beads. Each flexible securing element preferably has first and second free ends that pass through openings in the plate for being joined together (e.g., knotted, twisted, wrapped) beneath the bottom surface of the plate for securing the beads to the plate.

In one embodiment, the frame preferably has at least one lateral opening on a first lateral side of the frame and at least one lateral opening on a second lateral side of the frame. In one embodiment, a plurality of decorative accessories are connected together by linking elements that pass through the lateral openings in the frames. The linking elements may be flexible or non-flexible. In one embodiment, the linking elements may be made of metal and may be non-flexible.

In one embodiment, a decorative accessory preferably includes a plate, such as a rigid plate, having a lattice structure with crossed strips defining a plurality of evenly spaced openings extending from a top surface to a bottom surface of the plate, and a rigid frame connected with and extending around an outer perimeter of the rigid plate, whereby the frame projects from the bottom surface of the rigid plate to define a partially enclosed area located beneath the bottom surface of the rigid plate. In one embodiment, a plurality of beads overlie the top surface of the rigid plate, with each of the beads having an opening passing therethrough. A plurality of securing elements are utilized for securing the beads to the rigid plate. In one embodiment, each the flexible securing elements passes through one of the openings of at least one of the beads. In one embodiment, each flexible securing element desirably has first and second free ends that pass through openings on the rigid plate, whereby the first and second free ends of each the flexible securing element are joined together beneath the bottom surface of the rigid plate for securing the beads to the rigid plate.

In one embodiment, a second decorative accessory is similar to the first decorative accessory, and the frames of the decorative accessories have lateral openings adapted to receive interconnecting links for interconnecting the first and second decorative accessories.

In one embodiment, beads may be strung onto a decorative accessory by using a flexible beading wire that does not knot. Instead, the beads may be secured to the ends of the beading wire by crimping the ends of the wire, without using knots, ties and/or twists for securing the beads to the plate. In one embodiment, a leading end of a beading wire is passed through holes in a crimp bead and a top bead. The leading end of the beading wire is then crimped to hold the wire and the top bead in place at the leading end of the beading wire. The tail end of the beading wire may be trimmed, preferably after crimping. Beads for a column are preferably strung onto the trailing end of the beading wire and advanced toward the crimp bead and the top bead. The trailing end of the beading wire is preferably fed through an opening at the top surface of the plate, starting at the top and going through to the underside of the plate. While holding the first bead column over the top surface of the plate, the trailing end of the beading wire is passed up through another opening in the plate, beaded, and then the beading wire is passed back down through the plate for forming another bead column, without forming a knot, tie or twist below the plate. The above-described steps are continued for forming additional bead columns without using knots, ties and/or twists until a final bead column has been formed above the top surface of the plate. At that stage, the trailing end of the beading wire is crimped to secure the last bead column to the wire. In one embodiment, this may be accomplished by passing a crimp bead and a top bead onto the trailing end of the wire, and then crimping the trailing end of the beading wore to secure the crimp bead and the top bead onto the trailing end of the beading wire. Any excess on the trailing end of the beading wire may be trimmed.

These and other preferred embodiments of the present invention will be described in more detail below.

BRIEF DESCRIPTION OF THE DRAWINGS

FIG. 7C-1 shows a magnified view of an underside of the decorative accessory shown in FIG. 7C.

FIG. 12A shows a top plan view of a decorative accessory including a plurality of the long oval links shown in FIGS. 11A-11D joined together, in accordance with one embodiment of the present invention.

FIG. 12B shows a magnified view of a portion of the decorative accessory shown in FIG. 12A.

DETAILED DESCRIPTION

Figure 1:
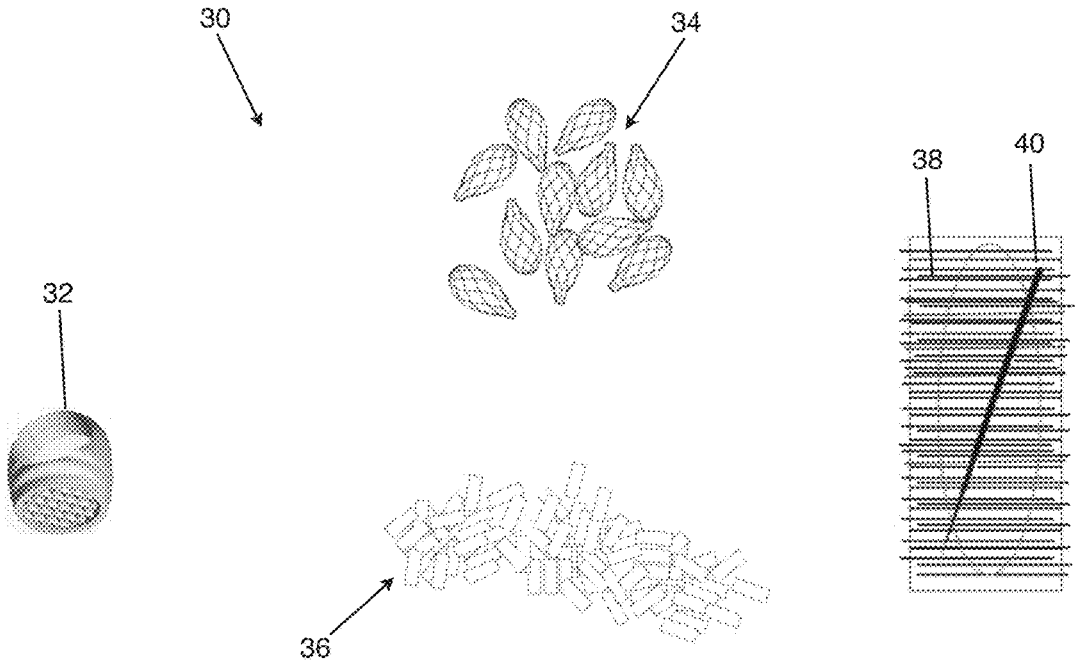
FIG. 1 shows a kit for making a decorative accessory including a ring, tear drop beads, bugle beads, a flexible securing element, and a needle, in accordance with one embodiment of the present invention.

Referring to FIG. 1, in one embodiment of the present invention, a kit 30 has components for making decorative accessories. The components desirably include a ring 32, first beads 34, second beads 36, a flexible securing element 38 for securing the beads to the ring, and a needle 40. In one embodiment, the components of the kit 30 are stored together within a container such as a box. In one embodiment, each of the components is stored in a separate container, such as a zip-lock bag. In one embodiment, the first beads 34 are tear drop shaped beads and the second beads 36 are bugle beads. In other embodiments, however, the beads may have different shapes and configurations and three or more different types of beads may be secured to a decorative accessory, such as the ring 32. In one embodiment, the flexible securing element 38 is flexible thread.

Figure 2A:
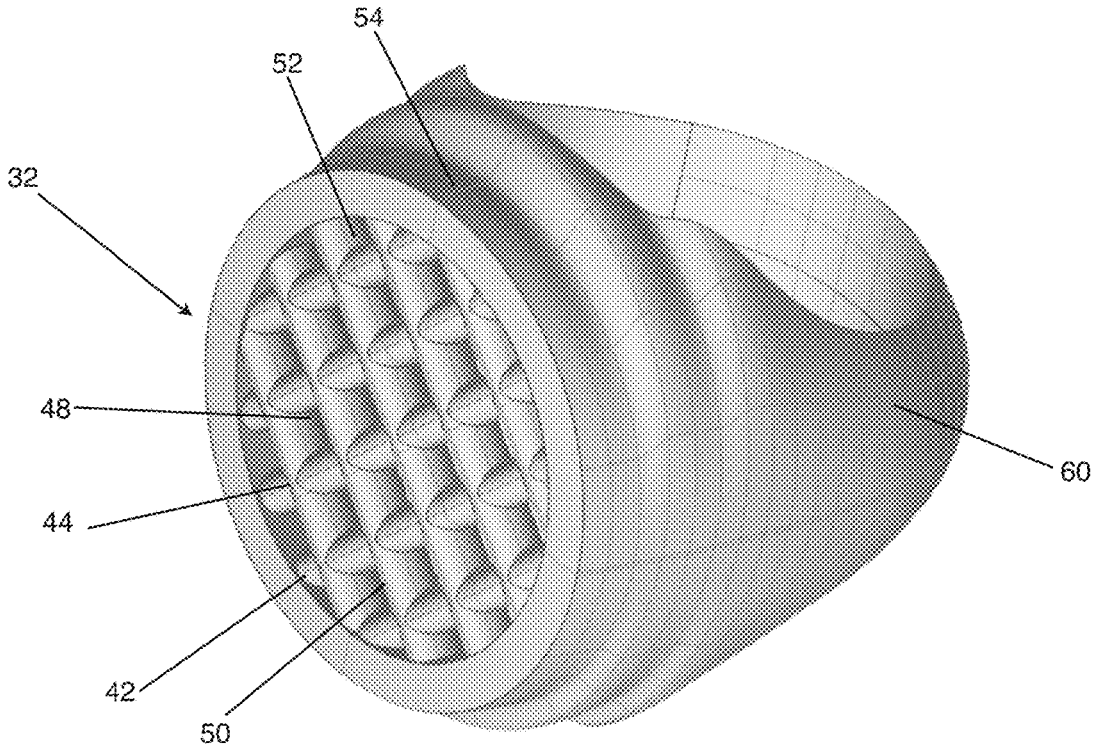
FIGS. 2A-2C show the ring shown in FIG. 1.
Figure 2B:
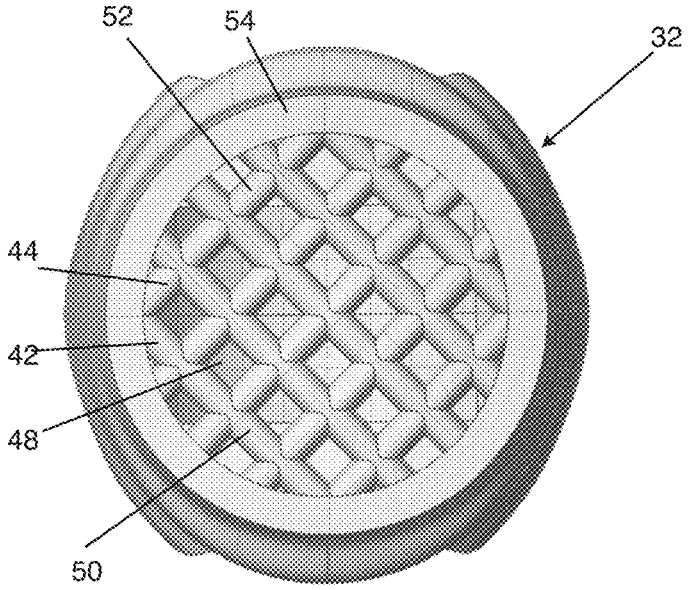
Figure 2C:
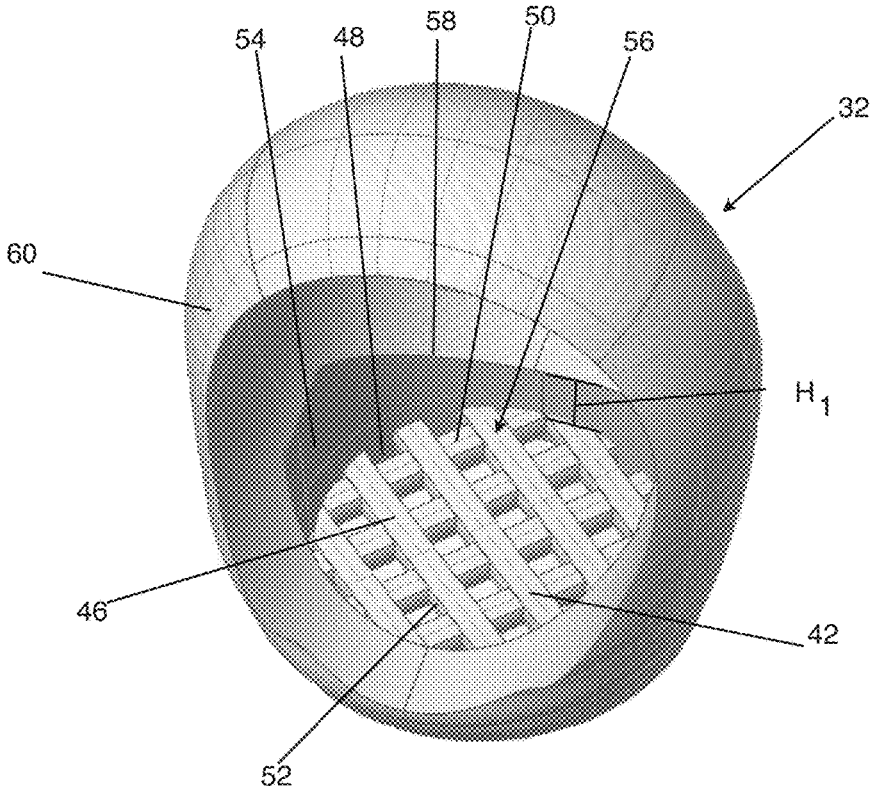

Referring to FIGS. 2A-2C, in one embodiment, the ring 32 preferably includes a plate 42 having a top surface 44 and a bottom surface 46 with a plurality of openings 48 extending through the plate 42. The plate 42 may be flat. In one embodiment, the plate may be rigid. In one embodiment, the openings 48 desirably extend from the top surface 44 to the bottom surface 46 of the plate. In one embodiment, the flat plate 42 has a lattice structure including crossed strips 50, 52 that define spaced openings 48 therebetween. In one embodiment, the openings 48 are evenly spaced from one another.

In one preferred embodiment, the ring 32 preferably includes a frame 54 connected with and extending around an outer perimeter of the flat plate 42. The frame 54 projects from the bottom surface 46 of the plate to define a partially enclosed area 56 located beneath the bottom surface 46 of the plate 42. The lower end surface 58 of the frame 54 is spaced from the bottom surface 46 of the plate 42 to define a height $H_1$ of the partially enclosed area 56 that extends from the bottom surface of the plate 42 to the lower end 58 of the frame 54. In one embodiment, the height $H_1$ is about 2-20 mm, more preferably about 3-6 mm, and even more preferably about 4 mm. Referring to FIGS. 2A and 2C, in one embodiment, the ring 32 preferably includes a shank 60 projecting below the frame 54 to enable the ring 32 to be secured to a finger.

Figure 3:
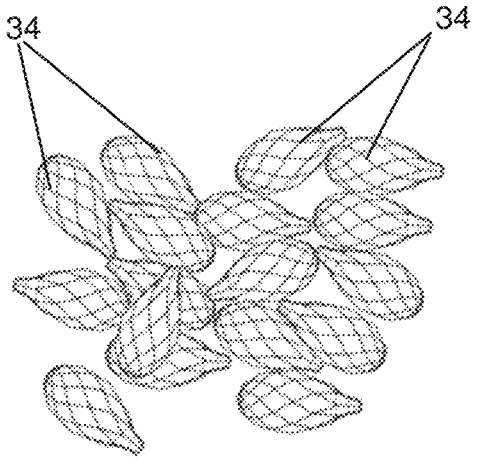
FIG. 3 shows the tear drop beads shown in FIG. 1.

Referring to FIG. 3, in one embodiment, the kit 30 (FIG. 1) includes the first beads 34, such as tear drop beads, that are adapted to be secured over the top surface of the plate 42 shown in FIG. 2A. In one embodiment, each of the tear drop beads 34 has a hole extending therethrough so that the flexible securing element 38 (FIG. 1) may be passed through each tear drop bead for securing the tear drop beads to a decorative accessory, as will be described in more detail herein.

Figure 4:
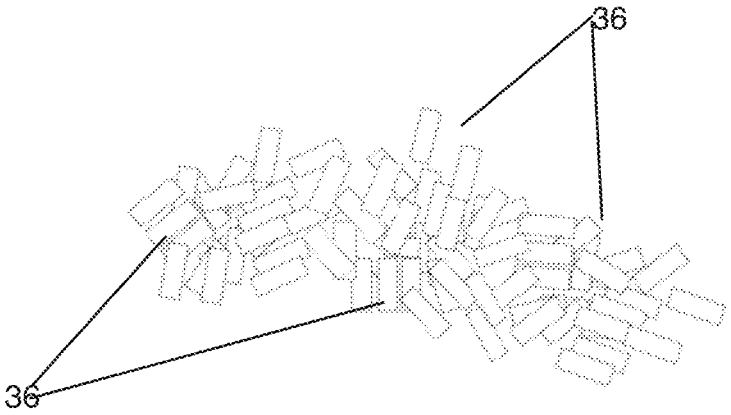
FIG. 4 shows the bugle beads shown in FIG. 1.

Referring to FIG. 4, in one embodiment, the kit for making a decorative accessory preferably includes a plurality of second beads 36, such as bugle beads. In one embodiment, each of the second beads 36 has a tubular shape with a tubular shaped opening extending from a first end to a second end of the bead. The flexible securing element is desirably passed through the tubular shaped opening of the second beads for securing the second beads over the top surface of the plate.

Figure 5:
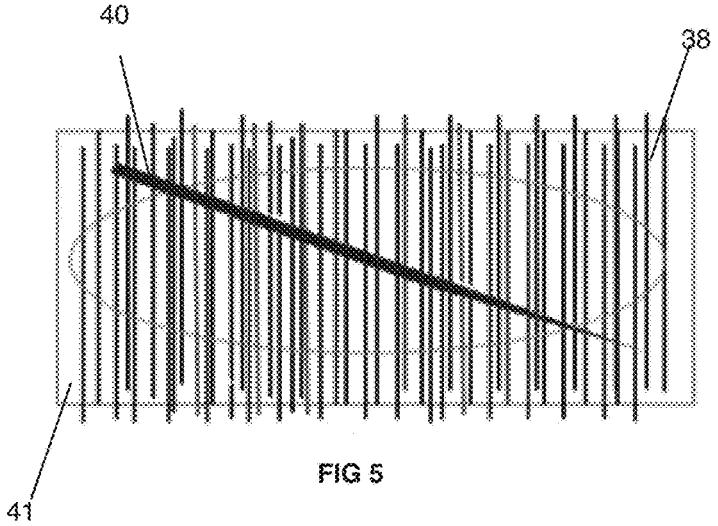
FIG. 5 shows the thread and the needle shown in FIG. 1.

Referring to FIG. 5, in one embodiment, the kit preferably includes the flexible securing element 38, such as flexible thread, that may be wrapped around a storage substrate 41. The kit preferably includes a needle 40 that may be secured to an end of the flexible securing element 38. As will be described in more detail herein, the needle 40 is passed through the openings in the beads for securing the beads to a decorative accessory, such as the ring 32 shown and described above in FIGS. 1 and 2A-2C.

Figure 6A:
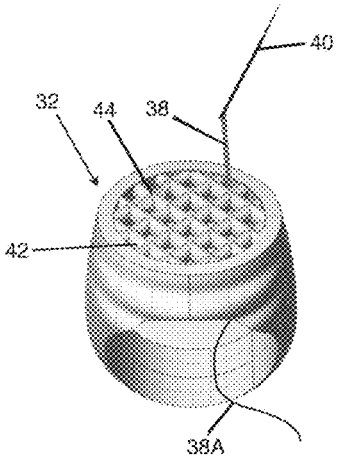
FIGS. 6A-6C show a method of making a decorative accessory including a ring, bugle beads, tear drop beads, a flexible securing element and a needle, in accordance with one embodiment of the present invention.

Referring to FIG. 6A, in one embodiment, a decorative accessory preferably includes the ring 32 shown and described above in FIGS. 2A-2C. Referring to FIGS. 5 and 6A, in one embodiment, the thread 38 is passed through the eye of the needle 40 with approximately 2 yards of the thread doubled over without a knot being formed at the trailing end of the thread. Referring to FIG. 6A, in one embodiment, starting from the inside of the ring 32, the needle 40 and the thread 38 are pulled through one of the openings 48 of the plate 42, leaving a tail 38A of the thread below the plate. In one embodiment, the tail 38A may have a length of about five-seven inches.

In one embodiment, the needle 40 and the connected thread 38 are preferably pulled down through an adjacent opening and knotted off on the underside of the ring 32. In one embodiment, rather than forming a knot, the thread may be joined with the tail 38A by twisting the ends together or using another conventional joining means. In one embodiment, after the knot is formed, the thread 38 is not cut. The needle 40 is preferably brought back up through another opening 48 in the plate 42 so that the needle 40 and the thread 38 are above the top surface 44 of the plate 42 as shown in FIG. 6A.

Figure 6B:
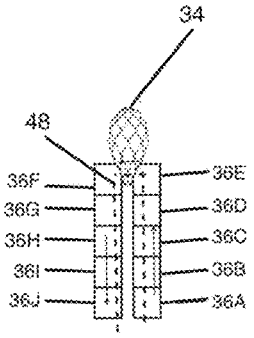

Referring to FIG. 6B, in one embodiment, a first loop of beads are formed by passing bugle beads 36A-36E over the needle 40 and onto the thread 38 until the lower most bugle bead 36A abuts against the top surface 44 of the plate 42. The thread 38 is desirably passed through the hole of a tear drop bead 34 and then through the final bugle beads 36F-36J. The thread may then be passed down through the plate. The thread may then be joined with the tail 38A within the partially enclosed area under the plate 42 of the ring 32 such as by forming a knot between the thread 38 and the tail 38A. In one embodiment, after the knot, tie and/or twist is formed, the needle 40 and the thread 38 may be passed through the next opening and the above described steps repeated for forming another loop bead structure including a plurality of the bugle beads and a tear drop bead as shown in FIG. 6B. In one embodiment, the thread may not be tied to, knotted or twisted to the tail, but rather may be passed through another opening to be above the top surface of the plate for stringing another loop of beads onto the thread.

Figure 6C:
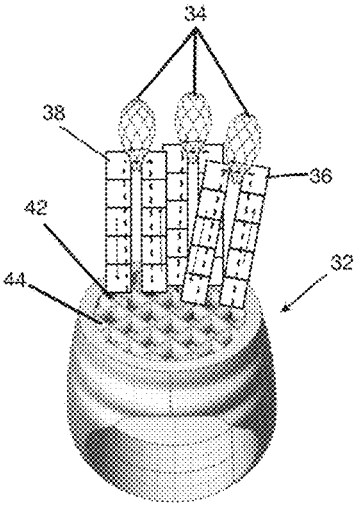

FIG. 6C shows a plurality of bead loops columns secured over the top surface 44 of the plate 42 of the ring 32. Each loop of beads desirably includes a plurality of bugle beads 36 and a tear drop bead 34. The thread 38 is preferably strung through the bugle beads and the tear drop bead and joined (e.g., tied, knotted) underneath the bottom surface of plate 42. The knot is preferably disposed within the partially enclosed area 56 (FIG. 2C) located below the bottom surface of the flat plate 42, which is surrounded by the frame 54. In one embodiment, when insufficient thread remains for securing additional beads to the plate, a new thread may be started using about two yards of thread and using the same steps as shown and described above. In one embodiment, the thread that is passed through the beads and into the partially enclosed area is knotted with the tail 38A (FIG. 6A).

In one embodiment, the thread is preferably pulled tight while beading since it may relax slightly once the beading process is completed. In one embodiment, once the beading process is completed, a knot is preferably formed underneath the plate between the thread and the tail 38A of the thread. If the bead design secured over the top surface of the plate is thin (e.g., an area of the plate is bare and not covered by beads), additional columns or loops of beads may be added utilizing the above-described steps. When an aesthetically pleasing number of columns, loops and/or beads have been secured over the top surface of the plate, a fixing element such as glue or adhesive may be applied over the knots for enhancing the securing of the beads to the decorative accessory.

Figure 7A:
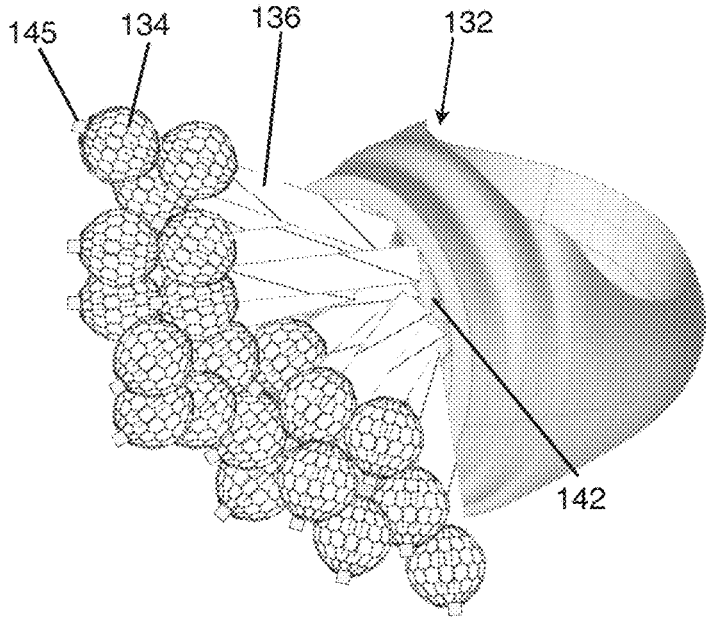
FIGS. 7A-7C show a decorative accessory including a ring and beads secured to the ring using flexible securing elements, in accordance with one embodiment of the present invention.
Figure 7B:
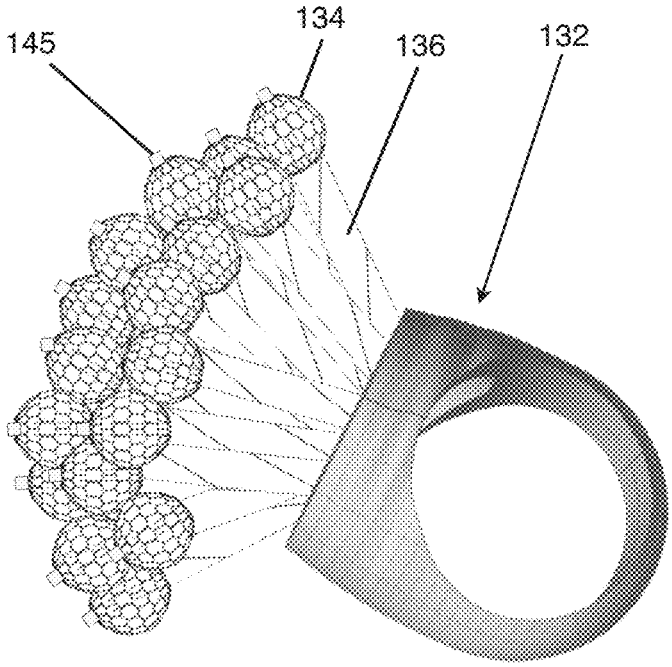

Referring to FIGS. 7A and 7B, in one embodiment of the present invention, a decorative accessory preferably includes a ring 132 having a plurality of beads 134, 136, 145 secured over a top surface of a flat plate 142 of the ring 132. Flexible securing elements such as the flexible thread shown and described above in FIGS. 5 and 6A-6C are utilized for securing the beads to the plate. In one embodiment, the flexible thread desirably passes through a first bead 136, such as an elongated bugle bead, a second bead 134, such as a spherical bead, and a third bead 145, such as a seed bead. The second and third beads 134, 145 are preferably located at upper ends of the respective first beads 136. Although three beads are shown in FIGS. 7A and 7B, the present invention contemplates that any number and/or combination of different types of beads may be utilized and still fall within the scope of the present invention.

Figure 7C:
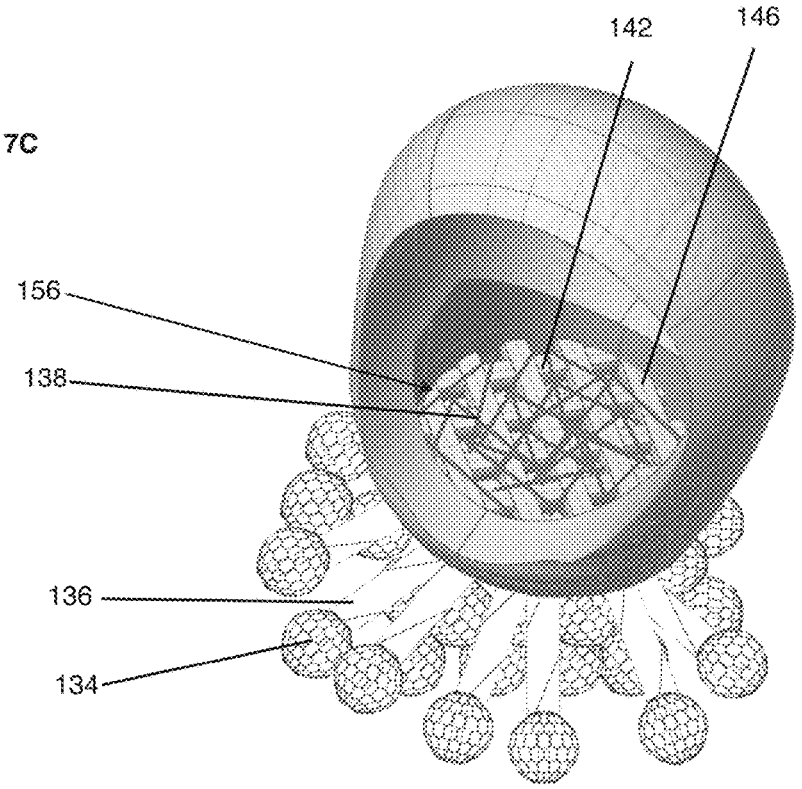
Figures 1, 7C:
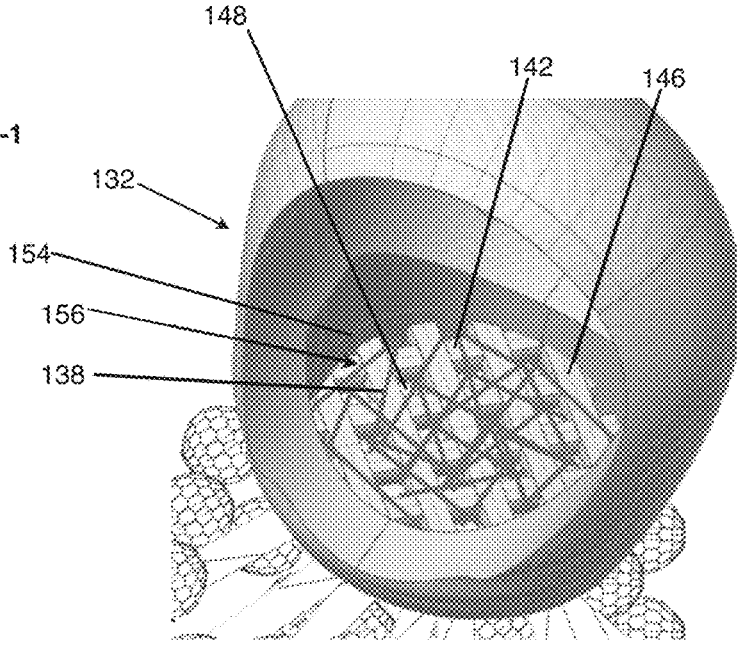

Referring to FIG. 7C, in one embodiment, after the thread 138 is strung through an elongated bugle bead 136, a spherical bead 134, a seed bead 145, and back through the a spherical bead and the elongated bugle bead 136, it is preferably passed through the next opening in the plate and into the partially enclosed area 156 located beneath the bottom surface 146 of the plate 142. In one embodiment, the thread may be joined, knotted, tied, and/or twisted below the plate for securing the beads to the plate. In one embodiment, the thread is not joined, knotted, tied and/or twisted each time the thread is passed below the plate, but is simply passed through another opening for being strung through additional beads located above the plate. FIG. 7C-1 shows a magnified view of the knotted thread 138 located within the partially enclosed area 156 that lies beneath the bottom surface 146 of the flat plate 142. The thread 138 is passed through the openings 148 formed in the flat plate. The partially enclosed area 156 is surrounded by the outer frame 154 of the ring 132, which is connected to and surrounds the outer perimeter of the flat plate 142. The partially enclosed area defines a recess underneath the bottom surface 146 of the flat plated 142 that accommodates the joined, knotted, tied and/or twisted thread 138 so that it does not rub against an opposing skin surface when the ring 132 is placed onto a finger.

Figure 8A:
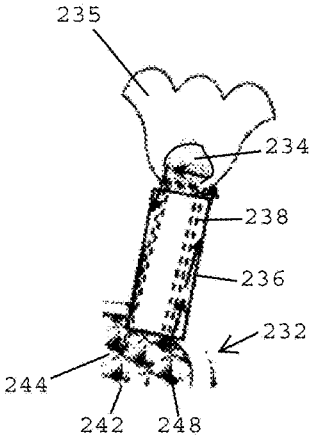
FIGS. 8A-8C show a method of making a decorative accessory, in accordance with one embodiment of the present invention.

Referring to FIG. 8A, in one embodiment, a decorative accessory preferably includes a ring 232 having a flat plate 242 with a plurality of openings 248 extending through the flat plate. A bugle bead 236 is positioned above the top surface 244 of the flat plate 242 and a thread 238 is passed from underneath the plate, through an opening in the plate, pulled above the top surface of the plate, and is strung through a bugle bead for exiting an upper end of the bugle bead.

In one embodiment, a drop bead 234 is positioned within a flower bead 235, which in turn is positioned above the upper end of the bugle bead 236. The thread is desirably passed through an opening at the bottom of the flower bead 235, through an opening in the drop bead 234, back through the bottom opening in the flower bead 235 and through the bugle bead 236. In one embodiment, the thread is preferably passed down through another opening 248 in the flat plate 242 and a knot is formed between the thread and a tail of the thread located beneath the flat plate 242 of the ring 232. In one embodiment, a knot is not formed each time the thread is passed below the plate. In this embodiment, the thread may be passed through another opening in the plate, without tying a knot, for being pulled up above the plate for stringing more beads onto the thread above the top surface of the plate.

Figure 8B:
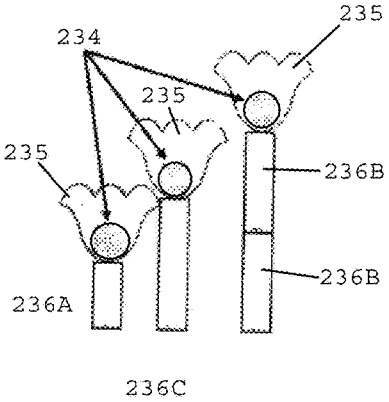

Referring to FIG. 8B, in one embodiment, the bugle beads 236 may have different lengths. A first bugle bead 236A preferably has a length of about six mm and a pair of second bugle beads 236B each preferably have a length of about nine mm. A third bugle bead 236C preferably has a length of about 12 mm. In other embodiments, other bugle beads may have different lengths.

Figure 8C:
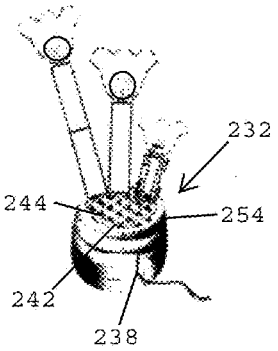

FIG. 8C shows a plurality of the bead columns shown in FIGS. 8A and 8B secured over the top surface 244 of a flat plate 242 of the ring 232. After the length of thread 238 has been looped through the beads and passed through the openings in the flat plate, knots are formed beneath the flat plate within the partially enclosed area surrounded by the frame 254 of the ring 232.

Figure 9A:
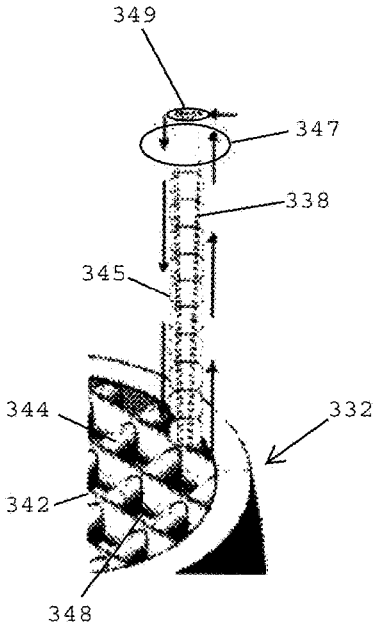
FIGS. 9A-9C show a method of making a decorative accessory, in accordance with one embodiment of the present invention.
Figure 9B:
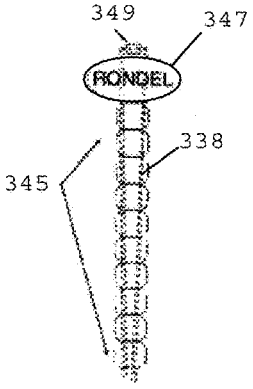
Figure 9C:
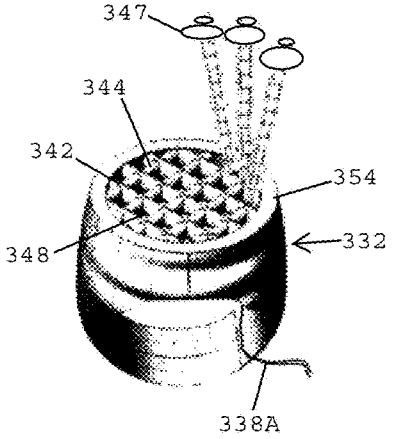

Referring to FIGS. 9A-9C, in embodiment, a decorative accessory preferably includes a ring 332 having a plate 342 with a plurality of openings 348 passing from a top surface 344 to a bottom surface (not shown) of the plate 342. Columns of beads are preferably stacked above the top surface 344 of the plate 342 and secured over the top surface using thread 338. In one embodiment, a plurality of third beads 345 such as seed beads are vertically stacked onto the thread 338. The thread is preferably passed through a fourth bead 347 such as a rondel bead, and a fifth bead 349 such as a delica bead, and then back through the seed beads 345 for passing through another opening 348 in the plate 342. The thread is preferably tied off into a knot located below the bottom surface of the flat plate 342. FIG. 9C shows a bead column formed by passing a thread 338 through the seed beads 345, the rondel bead 347 and the delica bead 349.

FIG. 9C shows a plurality of columns of stacked beads secured over the top surface 344 of the flat plate 342 of the ring 332. When the thread passes through the openings 348 to lie beneath the plate 342, the thread is desirably tied off into a knot with the tail 338A of the thread. The knots are preferably disposed within the partially enclosed area beneath the plate 342 that is surrounded by the frame 354. In one embodiment, glue or adhesive may be applied over the knots to ensure that the knots do not loosen and/or become unbound. In one embodiment, the threads are joined together below the plate without using knots, such as by twisting the flexible securing elements together.

Figure 10A:
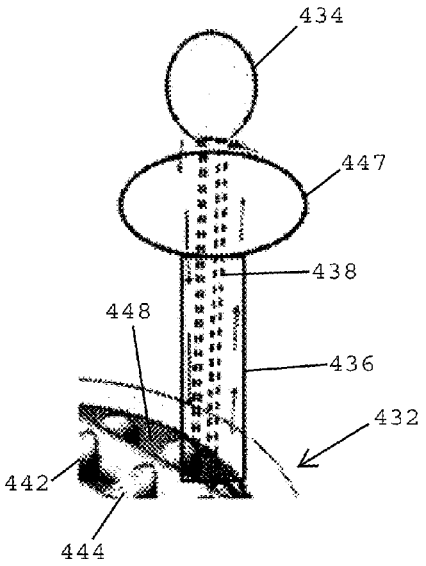
FIGS. 10A-10C show a method of making a decorative accessory, in accordance with one embodiment of the present invention.
Figure 10B:
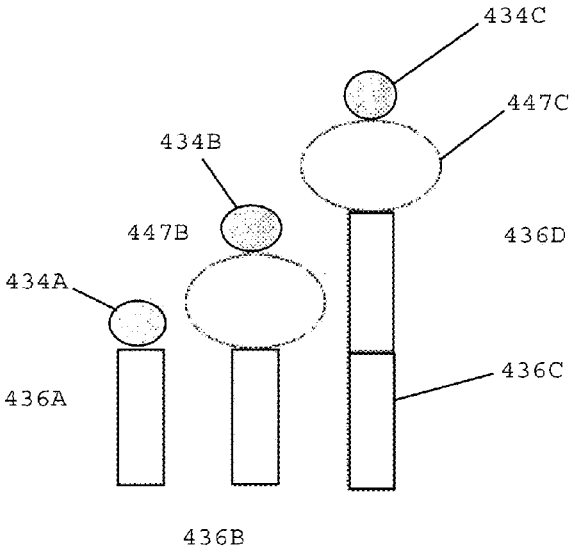
Figure 10C:
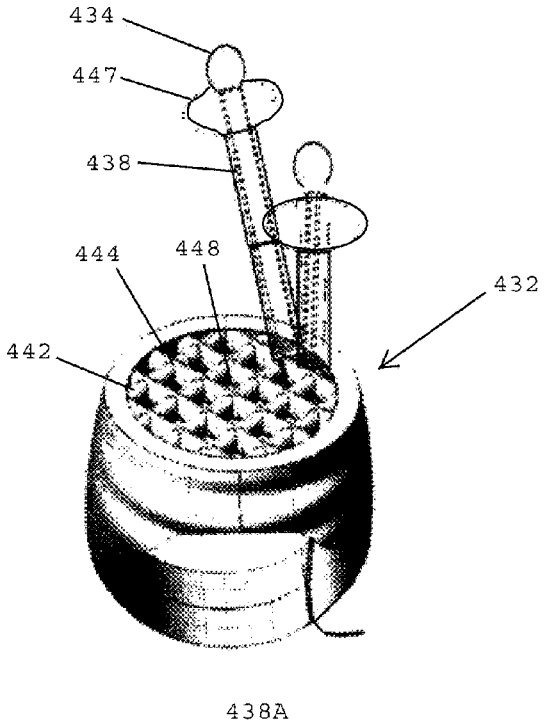

FIGS. 10A-10C show a decorative accessory, in accordance with another embodiment of the present invention. Referring to FIG. 10A, a decorative accessory preferably includes a ring 432 having a flat plate 442 with a top surface 444 and a bottom surface (not shown). The flat plate 442 preferably has a plurality of spaced openings 448 that extend from the top surface 444 to the bottom surface of the flat plate 442. In one embodiment, a bugle bead 436 is positioned over the top surface 444 of the flat plate 442. A thread 438 is passed through the bugle bead 432, a rondel bead 447 and a drop bead 434 and the thread then reverses direction for passing back through the rondel bead 447 and the bugle bead 436. The thread 438 passes through the lower end of the bugle bead 436 and passes through another opening 448 in the flat plate 442 for being disposed within a partially enclosed area located below the bottom surface of the flat plate 442.

Referring to FIG. 10B, in one embodiment, the columns of threaded beads may have different heights. In one embodiment, a first column includes a single bugle bead 436A and a single drop bead 434A, and a second column includes a single bugle bead 436B, a rondel bead 447B and a drop bead 434B. A third threaded column may include a first bugle bead 436C, a second bugle bead 436D, a rondel bead 447C and a drop bead 434C. As shown in FIG. 10B, the columns of threaded beads may have different heights.

FIG. 10C shows a plurality of columns of threaded beads secured over the top surface 444 of the flat plate 442 using a flexible securing element 438 such as thread. When the thread passes through the openings 448 of the plate 442 for being disposed beneath the bottom surface of the plate 442, the thread is joined with the tail 438A (e.g., knotted) of the thread located beneath the plate 442 of the ring 432.

Figure 11A:
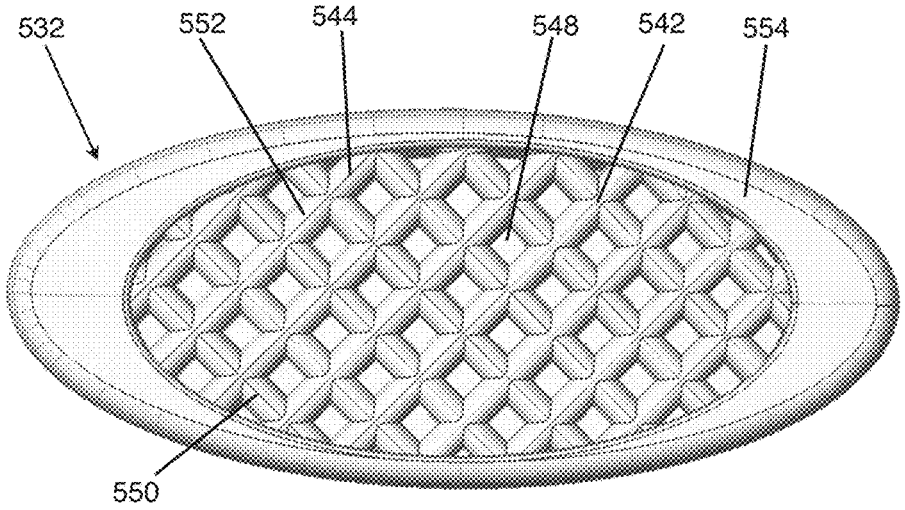
FIGS. 11A-11D show a long oval link used for making a decorative accessory, in accordance with one embodiment of the present invention.
Figure 11B:
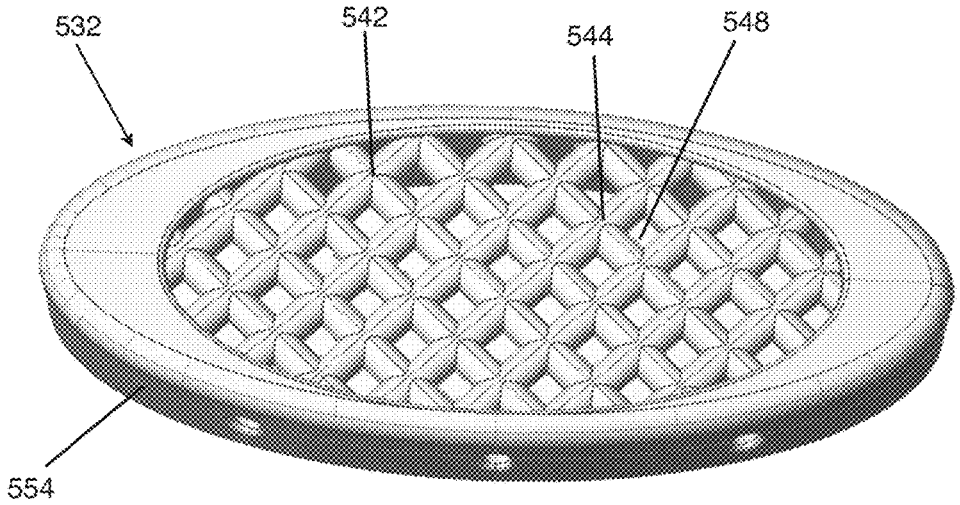

Referring to FIGS. 11A and 11B, in one embodiment, a decorative accessory preferably includes an oval link 532 having a flat plate 542 with a top surface 544, a bottom surface (not shown) and a plurality of openings 548 passing from the top surface 544 to the bottom surface of the plate. In one embodiment, the flat plate 542 is a lattice structure including crossed strips 550, 552 that define spaced openings 548 therebetween. The spaced openings may be evenly spaced. In one embodiment, the decorative accessory includes the flat plate 542 having an outer perimeter and a frame 554 that is connected to and surrounds the outer perimeter of the flat plate. Beads may be secured over the top surface of the plate as shown and described herein (e.g., FIGS. 10A-10C).

Figure 11C:
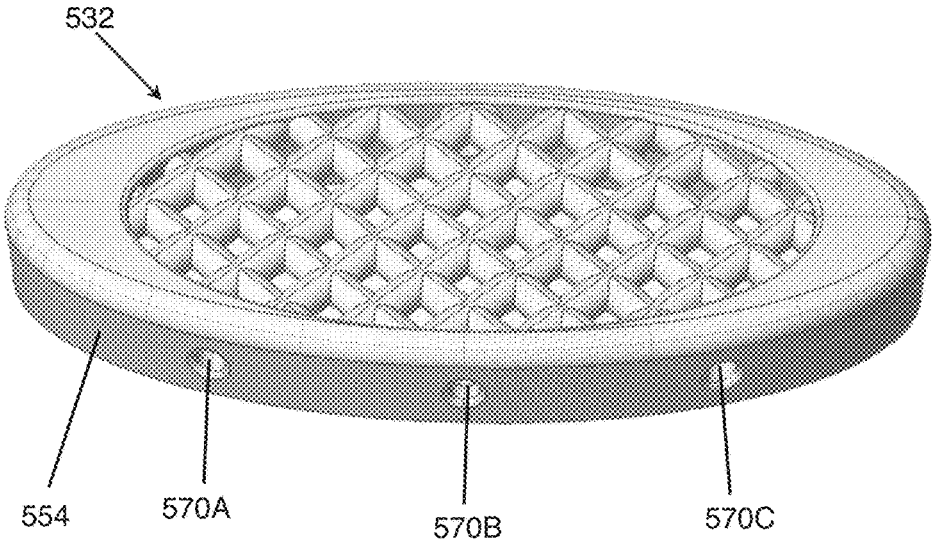
Figure 11D:
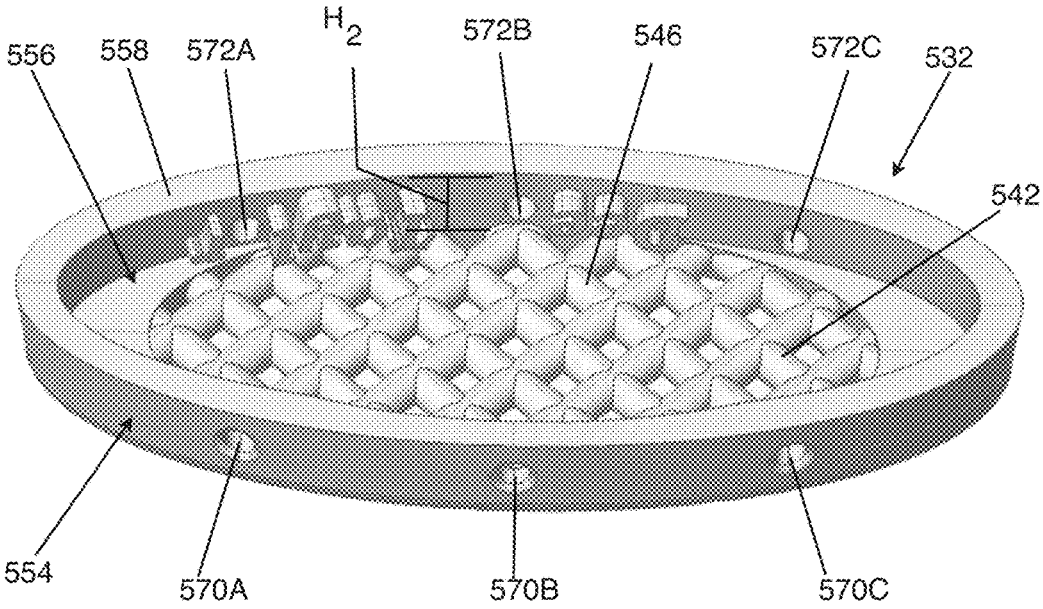

Referring to FIGS. 11B-11D, the frame 554 desirably includes a first set of lateral openings 570A-5700 passing through one lateral side of the frame 554 and a second set of lateral openings 572A-572C passing through an opposite lateral side of the outer frame 554. The lateral openings are preferably utilized for connecting the oval link 532 to one or more additional links.

Referring to FIG. 11D, in one embodiment, opposing lateral openings 570A and 572A are aligned with one another, opposing lateral openings 570B and 572B are aligned with one another, and opposing lateral openings 570C and 572C are aligned with one another. The frame 554 preferably has a lower end 558 that projects the bottom surface 546 of the flat plate 542 to define a partially enclosed area 556 surrounding the outer perimeter of the flat plate 542. The distance between the bottom surface 546 of the flat plate 542 and the lower end 558 of the outer frame 554 defines a height $H_2$ of about 2-20 mm, more preferably about 3-6 mm, and even more preferably about 4 mm. The height $H_2$ of the partially enclosed area 556 provides a space for the joined thread (e.g., knotted) beneath the bottom surface 546 of the flat plate 542 so that the decorative accessory 532 may lie flat upon a surface such as a skin surface or the outer surface of a garment. In one embodiment, the height of the frame may be even greater than that described above, such as for a decorative box used in the home or office.

Referring to FIG. 12A, in one embodiment, a plurality of the oval links 532A-532F shown above in FIGS. 11A-11D may be joined together. In FIG. 12A, six oval links 532A-532F may be interconnected using a flexible interconnecting element such as flexible thread 538. In one embodiment, the flexible thread 538 is desirably passed through beads and through the lateral openings 570A-570C and 572A-572C shown and described above in FIGS. 11C and 11D for interconnecting the adjacent oval links 532A-532F.

Figure 12C:
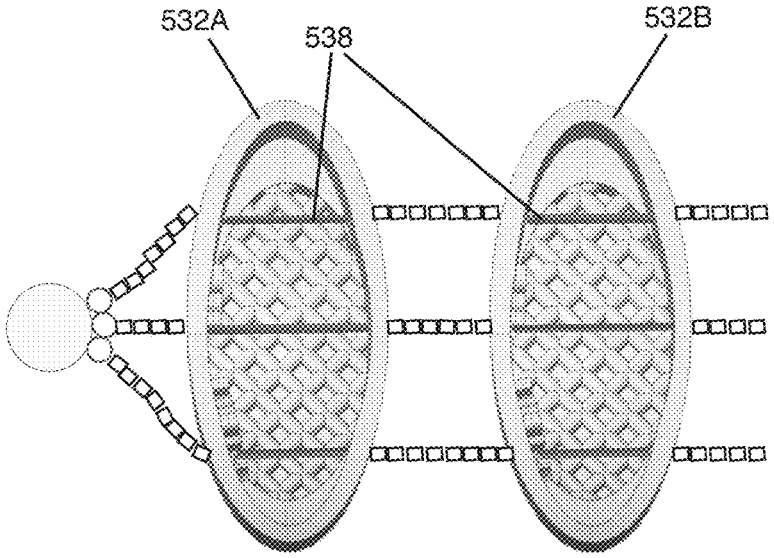
FIGS. 12C and 12D show an underside view of the decorative accessory shown in FIGS. 12A and 12B.
Figure 12D:
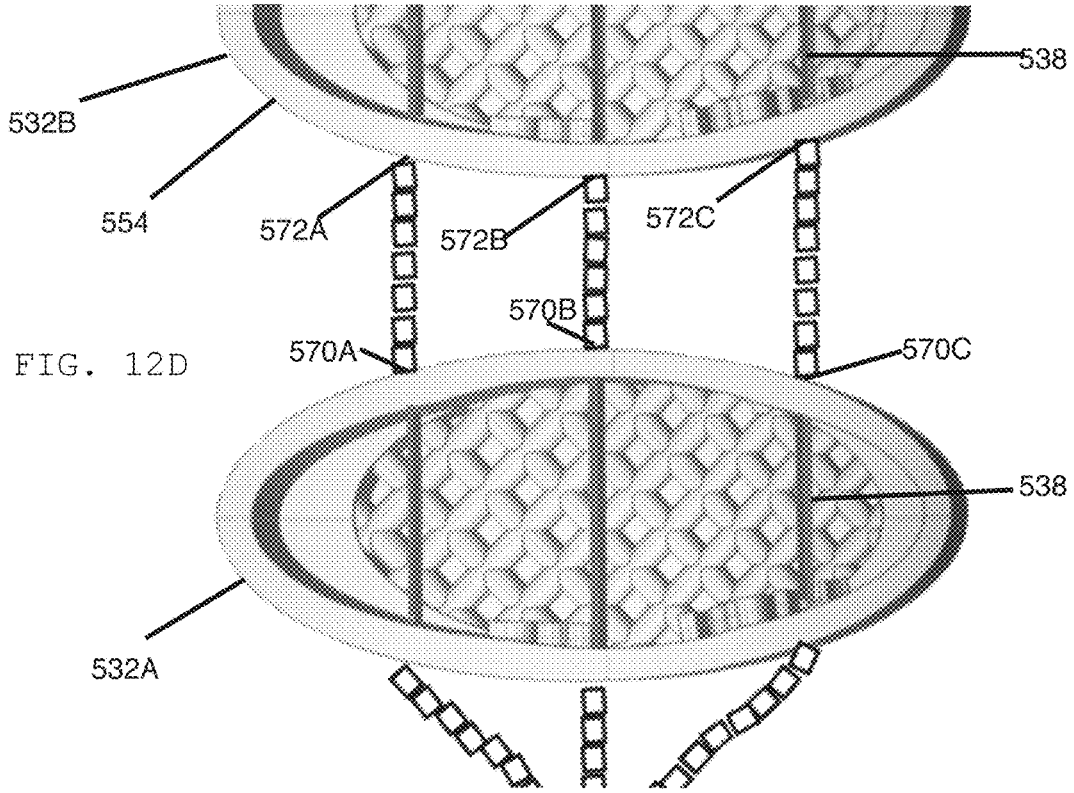

FIG. 12B shows adjacent oval links 532A, 532B being joined together by thread 538 that passes through the lateral openings provided on the links. The thread extending between the links may be covered by a plurality of beads 575. FIGS. 12C and 12D show the underside of adjacent oval links 532A, 532B. The thread 538 passes through the lateral openings 570A-570C for interconnecting with an adjacent oval link 532B. The first and second links 532A and 532B are interconnected by passing the thread 538 through the lateral openings 572A-572C in the outer flange 554 of the second oval link 532B.

The decorative accessory shown in FIGS. 11A-11D and 12A-12D may be decorated with beads by utilizing thread for securing beads over the top surface of the flat plate as shown and described herein. Any of the combinations of beads shown and described herein may be utilized for decorating any of the links shown and described herein.

Figure 13A:
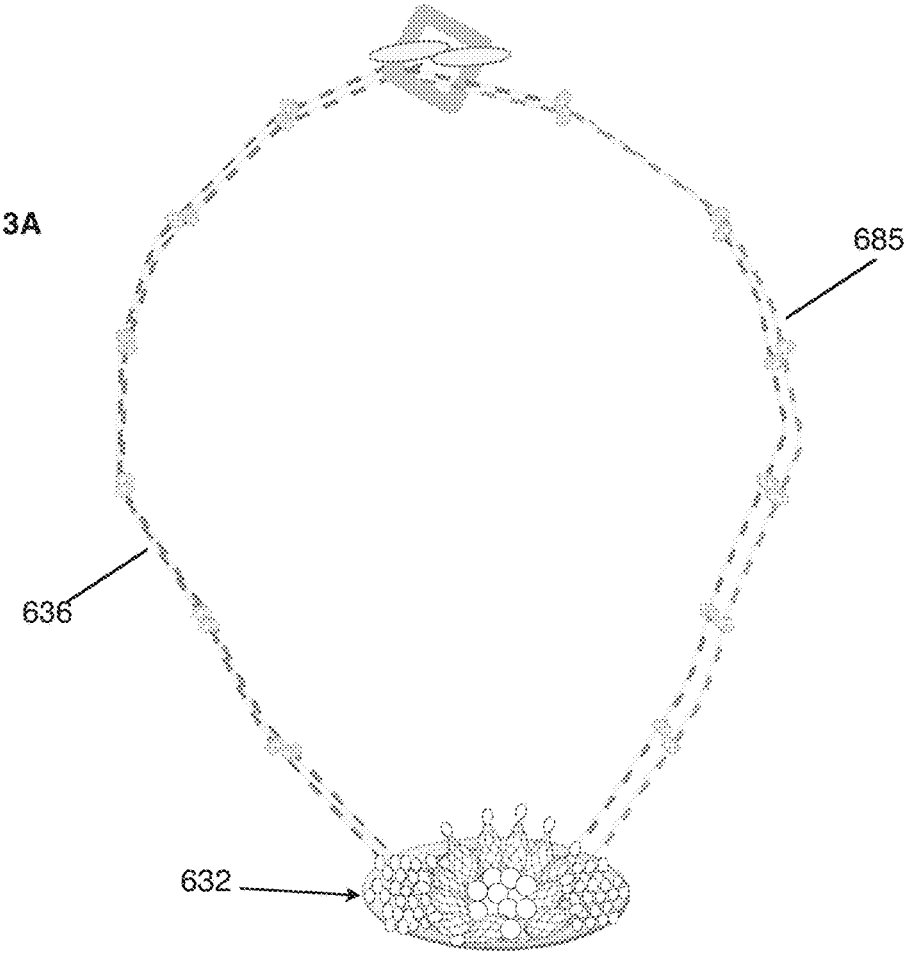
FIG. 13A shows a perspective view of a necklace with a decorative accessory including a long oval link, in accordance with one embodiment of the present invention.
Figure 13B:
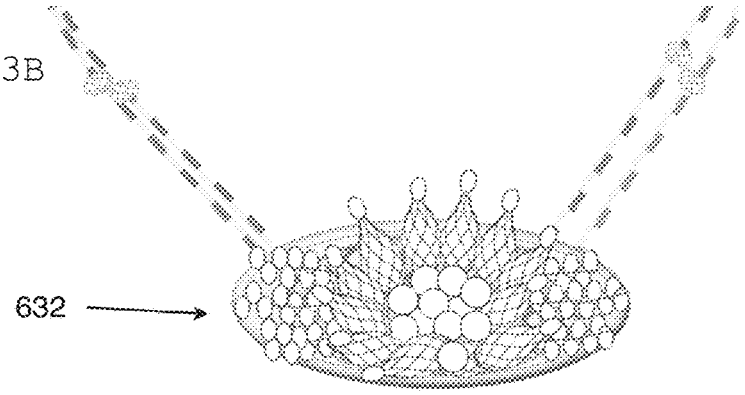
FIG. 13B shows a magnified view of the decorative accessory including the long oval link shown in FIG. 13A.

Referring to FIG. 13A, in one embodiment, a decorative accessory 632 that has been adorned with beads may be secured to a necklace 685. The necklace may be formed by passing thread through beads, such as bugle beads 636. FIG. 13B shows a top plan view of the decorative accessory 632 shown in FIG. 13A. A plurality of beads are secured over the top surface of a flat plate of an oval link 632.

Figure 13C:
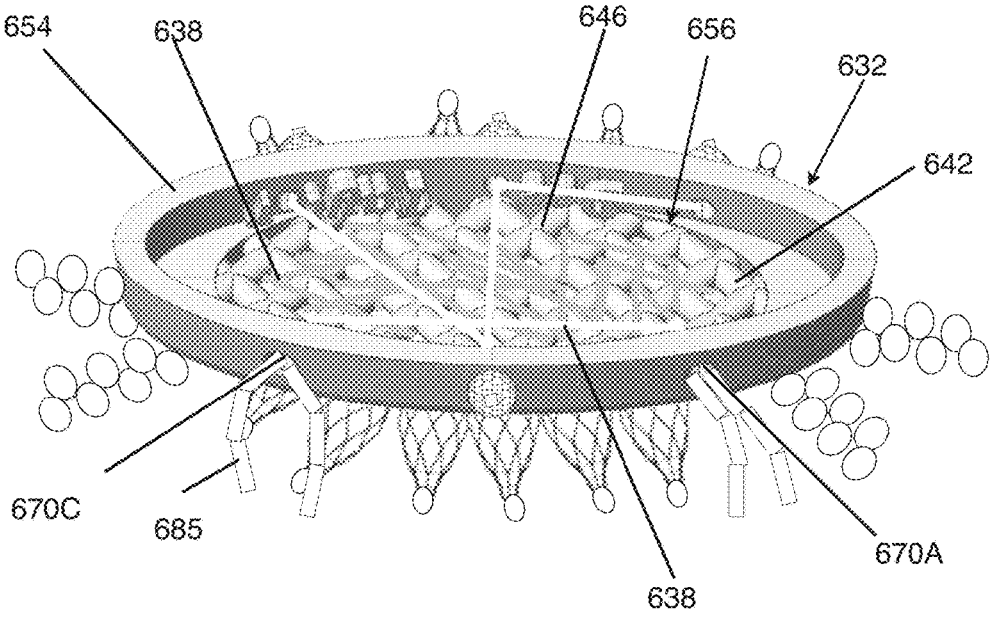
FIG. 13C shows an underside view of the decorative accessory and the long oval link shown in FIG. 13B.

Referring to FIG. 13C, in one embodiment, an underside of the decorative accessory 632 preferably includes the thread 638 being joined (e.g., knotted) within the partially enclosed area 656 that is surrounded by the outer frame 654. The knots of the thread 638 are disposed within the recess of the partially enclosed area 656 located beneath the bottom surface 646 of the flat plate 642.

Figure 13D:
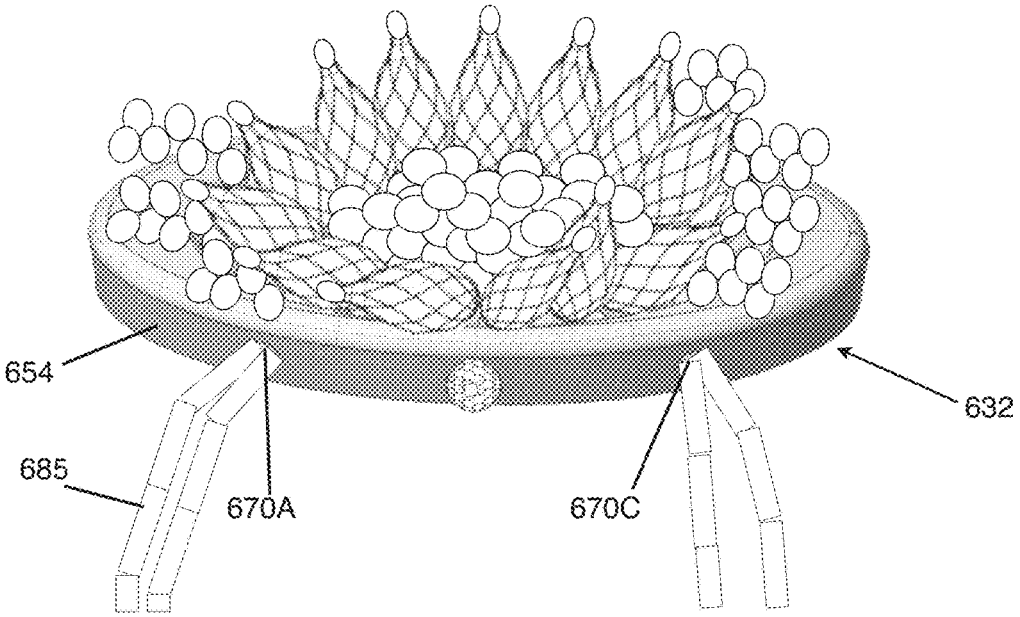
FIG. 13D shows a side view of the decorative accessory and the long oval link shown in FIGS. 13B and 13C.

Referring to FIGS. 13C and 13D, in one embodiment, the thread 638 utilized for forming the necklace 685 preferably passes through the first lateral opening 670A and the third lateral opening 670C in the outer frame 654 of the oval link 632 for interconnecting the link and the necklace 685.

Figure 14:
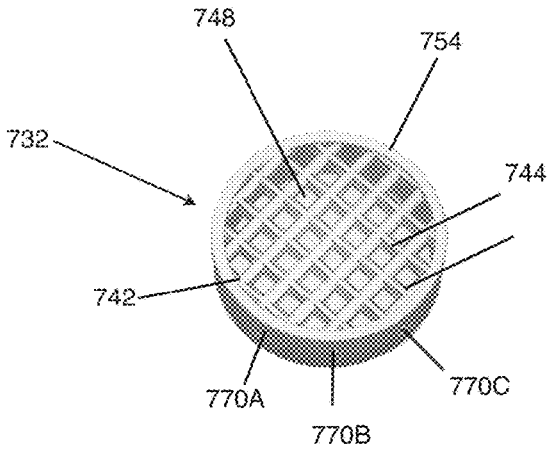
FIG. 14 shows a round link used to make a decorative accessory, in accordance with one embodiment of the present invention.

Referring to FIG. 14, in one embodiment, a decorative accessory preferably includes a round link 732 having a flat plate 742 with a top surface 744, a bottom surface (not shown) and a plurality of spaced openings 748 passing from the top surface to the bottom surface. The outer perimeter of the flat plate 742 is preferably surrounded by and connected with an outer frame 754 that defines a partially enclosed space located beneath the bottom surface of the flat plate 742 as shown and described herein. The outer frame preferably projects below the plate to define the partially enclosed space. In one embodiment, the frame 754 includes three lateral openings 770A-7700 passing therethrough that enable the circular link 732 to be connected with another link.

Figure 15A:
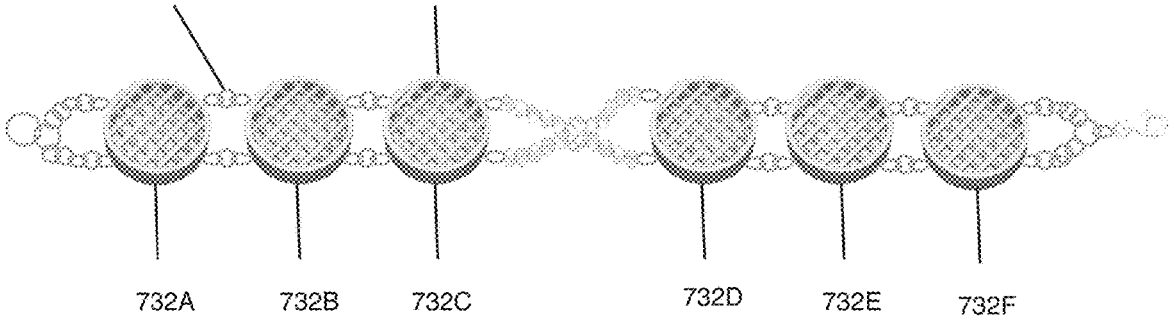
FIG. 15A shows a decorative accessory including a plurality of the round links shown in FIG. 14, in accordance with one embodiment of the present invention.
Figure 15B:
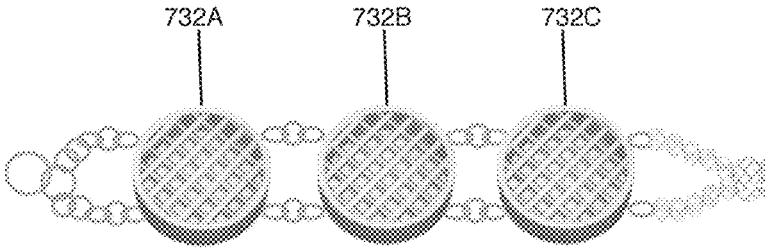
FIG. 15B shows a magnified view of a portion of the decorative accessory shown in FIG. 15A.

Referring to FIG. 15A, in one embodiment, a plurality of round links 732A-732F are connected together by passing linking elements 738, such as rigid or flexible linking elements, through the lateral openings provided in the outer frame 754 of the round link 732. FIG. 15B shows a magnified view of three round links 732A-732C being joined together. In one embodiment, the linking elements may include a center core including a flexible thread and beads strung onto the center core.

Figure 15C:
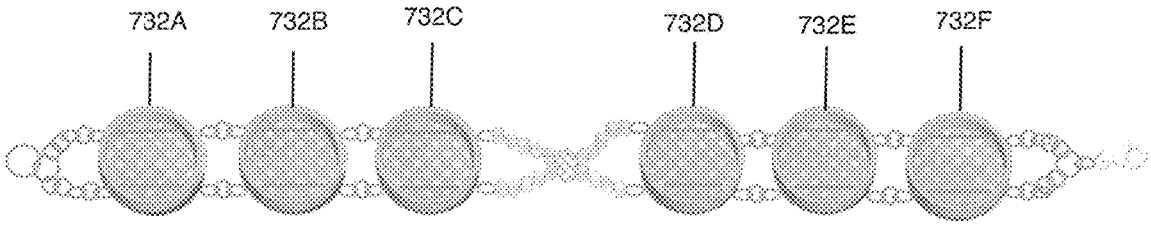
FIG. 15C shows a bottom side view of the decorative accessory shown in FIG. 15A.
Figure 15D:
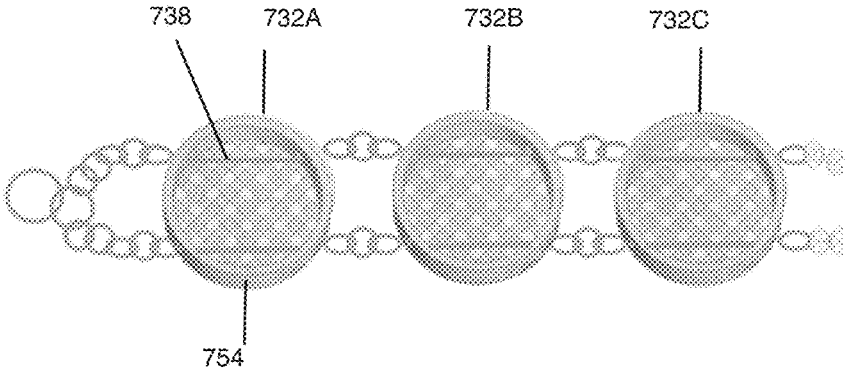
FIG. 15D shows a magnified view of the bottom side of the decorative accessory shown in FIG. 15C.

FIGS. 15C and 15D show the underside of the interconnected round links 732A-732F. The linking elements 738 pass through the lateral openings provided in the outer frame 754 to enable the linking elements to interconnect the circular links 732A-732F.

In other embodiments, decorative accessories may include links having different sizes, shapes and/or configurations. The methods described herein for securing beads to plates on the links may be utilized for each of the decorative accessories shown and described herein. In one embodiment, a decorative accessory includes a plurality of links that are joined together via linking elements, whereby all of the links have one or more openings through which the linking elements pass so that the links may be strung and/or joined together by the linking elements. In one embodiment, the links have paired openings that are aligned with one another and oppose one another on opposite sides of the link. In one embodiment, the links have outer frames and the frames have the openings that enable the links to be joined together using the thread and/or flexible securing element.

Figure 16:
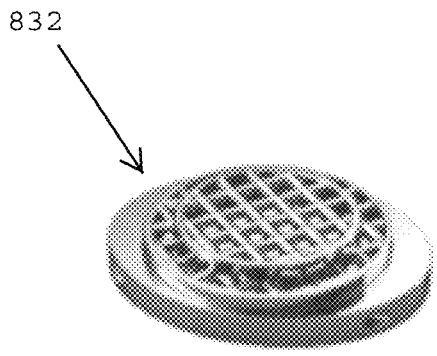
FIG. 16 shows a three-tiered oval link used for making a decorative accessory, in accordance with one embodiment of the present invention.

FIG. 16 shows a decorative accessory including a three tiered oval link 832. The oval links have openings for securing bead to the plates of the link.

Figure 17:
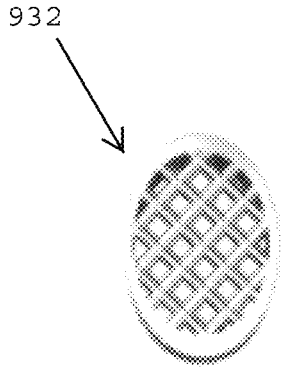
FIG. 17 shows an oval link used for making a decorative accessory, in accordance with another embodiment of the present invention.

FIG. 17 shows a decorative accessory including an oval link 932 with a plate having openings for securing beads to the plate using flexible securing elements.

Figure 18:
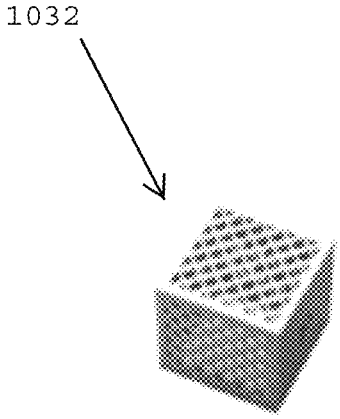
FIG. 18 shows a cube link used for making a decorative accessory, in accordance with yet another preferred embodiment of the present invention.

FIG. 18 shows a decorative accessory including a cube shaped link 1032 having multiple flat plates with a plurality of openings extending through each of the flat plates.

Figure 19:
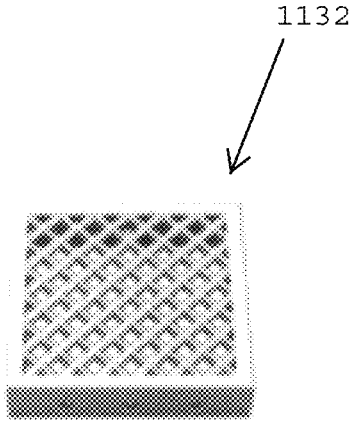
FIG. 19 shows a square link used for making a decorative accessory, in accordance with still another embodiment of the present invention.

FIG. 19 shows a decorative accessory including square link 1132 having a plate with openings.

Figure 20:
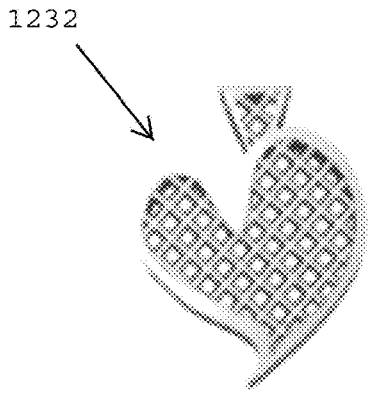
FIG. 20 shows a heart pendant link used for making a decorative accessory, in accordance with one embodiment of the present invention.

FIG. 20 shows a decorative accessory including a heart pendant 1232 having a plate with openings.

Figure 21:
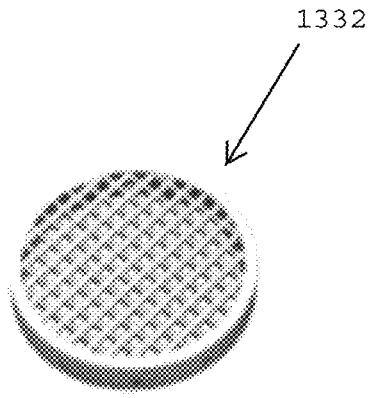
FIG. 21 shows a large round link used for making a decorative accessory, in accordance with another embodiment of the present invention.

FIG. 21 shows a decorative accessory including a large round link 1332 having a plate with openings.

Figure 22:
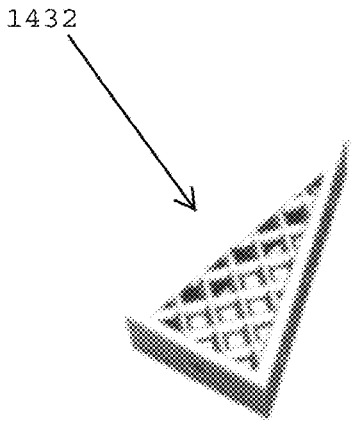
FIG. 22 shows a triangular shaped link used for making a decorative accessory, in accordance with yet another embodiment of the present invention.

FIG. 22 shows a decorative accessory including a triangular-shaped or Christmas tree link 1432 having a plate with openings.

Figure 23:
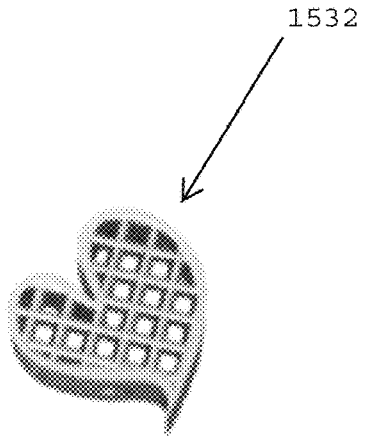
FIG. 23 shows a heart shaped link used for making a decorative accessory, in accordance with yet another embodiment of the present invention.

FIG. 23 shows a decorative accessory including a heart-shaped link 1532 having a frame with openings.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A decorative accessory comprising:

a plate having a top surface, a bottom surface, and a plurality of openings extending through said plate;

a frame connected with and extending around an outer perimeter of said plate, wherein said frame extends away from said bottom surface of said plate to define a partially enclosed area located beneath said bottom surface of said plate;

a plurality of beads positioned above said top surface of said plate;

at least one flexible securing element passing through said plurality of beads positioned above said top surface of said plate, said at least one flexible securing element having first and second free ends that pass through different openings in said plate, wherein said first and second free ends of said at least one flexible securing element are joined together beneath said bottom surface of said plate for securing said plurality of beads to said plate, wherein said plurality of beads are formed in a vertically stacked column that extends above and away from said top surface of said plate, and wherein said at least one flexible securing element extends upwardly from said top surface of said plate for passing though said plurality of beads that are formed in the vertically stacked column.

2. The decorative accessory as claimed in claim 1, wherein said plate is rigid, and wherein said openings are spaced from one another.

3. The decorative accessory as claimed in claim 2, wherein said plate comprises a lattice structure having crossed strips that define said spaced openings.

4. The decorative accessory as claimed in claim 1, wherein said joined first and second free ends of said at least one flexible securing element are knotted, tied or twisted together within said partially enclosed area located beneath said bottom surface of said plate, and wherein said decorative accessory further comprises a backing material inserted into said partially enclosed area beneath said bottom surface of said plate for covering said joined first and second free ends of said at least one flexible securing element.

5. The decorative accessory as claimed in claim 4, wherein said joined first and second free ends of said at least one flexible securing element engage at least one of said crossed strips of said lattice structure.

6. The decorative accessory as claimed in claim 1, further comprising:

a plurality of flexible securing elements for securing said beads to said plate, wherein free ends of said flexible securing elements are joined together beneath said bottom surface of said plate.

7. The decorative accessory as claimed in claim 6, wherein each of said flexible securing elements secures said plurality of beads to said plate.

8. The decorative accessory as claimed in claim 7, wherein said free ends of said flexible securing elements are joined together, and wherein said frame has a lower end that is spaced from said bottom surface of said plate for defining said partially enclosed area, and wherein said joined together flexible securing elements are surrounded by said frame and located within said partially enclosed area located beneath said bottom surface of said plate.

9. The decorative accessory as claimed in claim 8, wherein at least some of said joined together flexible securing elements abut against at least some of said crossed strips of said lattice structure of said plate.

10. The decorative accessory as claimed in claim 1, wherein said plate and said frame comprise materials selected from the group of materials consisting of metal, pewter, silver, gold, polymers, and plastics.

11. The decorative accessory as claimed in claim 1, wherein said at least one flexible securing element is selected from the group of securing elements consisting of nylon thread, flexible thread, polymer thread, wire, leather, ribbon, fabric, rope, string, yarn, hemp and pipe cleaners.

12. The decorative accessory as claimed in claim 1, wherein said decorative accessory is selected from the group consisting of jewelry, rings, hairpieces, clothing accessories, buttons, head bands, novelty boxes, storage boxes, storage containers, paper weights, bracelets, necklaces, neck pieces, earrings, ear cuffs, belt buckles, clasps, links, armlets, bangles, chains, brooches, anklets, lockets, pearls, connectors, charms, pendants, cuff links, tie pins, breastplates, nose rings, nose studs, key chains, door knob décor, scarf connectors, flower ties, gift ties, ribbon bow ties, novelty shapes, hair accessories, hair pins, hair sticks, barrettes, head bands, decorative scrunchies, head wraps, hair clips, ponytailers, hair claws, decorative combs, bun-holders, tiaras, napkin holders, place mats, vases, wine labels, glass labels, lamps, lampshades, light fixtures, plates, bowls, planting pots, curtains, curtain pull cords, light pulls, light switches, kitchen storage containers, bookends, table cloths, furniture accessories, studs, foot stools, table parts, desk accessories, organizers, drawer knobs, and door knobs.

13. The decorative accessory as claimed in claim 1, wherein said frame has one or more lateral openings extending therethrough.

14. A decorative accessory comprising:

a plate having a top surface, a bottom surface, and a plurality of openings extending through said plate;

a frame connected with and extending around an outer perimeter of said plate, wherein said frame projects from said bottom surface of said plate to define a partially enclosed area located beneath said bottom surface of said plate;

a plurality of beads positioned above said top surface of said plate;

a plurality of flexible securing elements for securing said beads above said top surface of said plate, wherein each said flexible securing element passes through at least one of said beads, wherein each said flexible securing element has first and second free ends that pass through openings in said plate for being joined together beneath said bottom surface of said plate for securing said beads to said plate, wherein said plurality of beads are formed in vertically stacked columns that extend above and away from said top surface of said plate, and wherein said flexible securing elements extend upwardly from said top surface of said plate for passing though said plurality of beads that are formed in the vertically stacked columns.

15. The decorative accessory as claimed in claim 14, wherein said plate is rigid, and wherein said frame has one or more lateral openings extending therethrough.

16. The decorative accessory as claimed in claim 15, wherein said frame has at least one lateral opening on a first lateral side of said frame and at least one lateral opening on a second lateral side of said frame.

17. The decorative accessory as claimed in claim 16, further comprising a plurality of decorative accessories that are connected together by linking elements that pass through said lateral openings in said frame.

18. The decorative accessory as claimed in claim 14, wherein said plate and said frame are rigid and comprise materials selected from the group of materials consisting of pewter, silver, gold, polymers, and plastics.

19. A decorative accessory comprising:

a rigid plate having a lattice structure with crossed strips defining a plurality of evenly spaced openings extending from a top surface to a bottom surface of said plate;

a rigid frame connected with and extending around an outer perimeter of said rigid plate, wherein said frame projects from said bottom surface of said rigid plate to define a partially enclosed area located beneath said bottom surface of said rigid plate;

a plurality of columns of vertically stacked beads overlying said top surface of said rigid plate, each said column comprising a first bead overlying said top surface of said rigid plate, and a second bead stacked on top of said first bead to form one of said columns of vertically stacked beads, each said bead having an opening passing therethrough;

a plurality of securing elements for securing said columns of vertically stacked beads to said rigid plate, wherein each said flexible securing element passes through one of said openings of at least one of said beads, wherein each said flexible securing element has first and second free ends that pass through openings on said rigid plate, and wherein said first and second free ends of each said flexible securing element are joined together beneath said bottom surface of said rigid plate for securing said beads to said rigid plate, wherein said columns of vertically stacked beads extend away from and above said top surface of said rigid plate, and wherein said flexible securing elements extend upwardly from said top surface of said rigid plate for passing though said columns of vertically stacked beads.

20. The decorative accessory as claimed in claim 19, further comprising a second decorative accessory that is similar to said first decorative accessory, wherein said frames of said decorative accessories have lateral openings adapted to receive links for interconnecting said first and second decorative accessories.

21. The decorative accessory as claimed in claim 1, wherein said vertically stacked column comprises a first bead positioned above said top surface of said plate and a second bead positioned on top of said first bead that is further away from said top surface of said plate than said first bead.

22. The decorative accessory as claimed in claim 14, wherein said plurality of beads comprise columns of vertically stacked beads positioned above said top surface of said plate, wherein each said column comprises a first bead positioned above said top surface of said plate and a second bead positioned above an upper end of said first bead, wherein said second bead of each said column of vertically stacked beads is further away from said top surface of said plate than said first bead of each said column of said vertically stacked beads.

23. The decorative accessory as claimed in claim 14, further comprising a backing material inserted into said partially enclosed area beneath said bottom surface of said plate for covering said joined together first and second free ends of said flexible securing elements.

24. The decorative accessory as claimed in claim 19, wherein said second bead stacked atop said first bead is further away from said top surface of said rigid plate than said first bead.

* * * * *